US009016691B1

(12) United States Patent
Donaldson

(10) Patent No.: US 9,016,691 B1
(45) Date of Patent: Apr. 28, 2015

(54) LIQUID SPLAT GAME KIT AND METHOD OF PLAY

(71) Applicant: Charles Donaldson, Ormond Beach, FL (US)

(72) Inventor: Charles Donaldson, Ormond Beach, FL (US)

( * ) Notice: Subject to any disclaimer, the term of this patent is extended or adjusted under 35 U.S.C. 154(b) by 70 days.

(21) Appl. No.: 14/024,715

(22) Filed: Oct. 4, 2013

(51) Int. Cl.
*G09B 23/24* (2006.01)
*A63F 1/02* (2006.01)

(52) U.S. Cl.
CPC ..... *A63F 1/02* (2013.01)

(58) Field of Classification Search
CPC ..... G09B 23/24; A63H 13/15
See application file for complete search history.

(56) References Cited

U.S. PATENT DOCUMENTS

| | | | | |
|---|---|---|---|---|
| 1,890,004 | A * | 12/1932 | Schubert | 434/84 |
| 4,830,690 | A * | 5/1989 | Cooper | 156/63 |
| 5,213,505 | A * | 5/1993 | Laipply | 434/96 |
| 2002/0142271 | A1 * | 10/2002 | Curtin | 434/167 |

* cited by examiner

*Primary Examiner* — Michael Dennis
(74) *Attorney, Agent, or Firm* — Jason T. Daniel, Esq.; Daniel Law Offices, P.A.

(57) ABSTRACT

One embodiment of a liquid splat game kit includes a plurality of squirt bottles for storing water, a plurality of water coloring tablets for transitioning the water into a colored liquid, a plurality of playing cards, and a game-play manual.

19 Claims, 5 Drawing Sheets

LIQUID SPLAT GAME KIT AND METHOD OF PLAY

TECHNICAL FIELD

The present invention relates generally to boardless games, and more particularly to an interactive multi-player game and method of playing the same.

BACKGROUND

The statements in this section merely provide background information related to the present disclosure and may not constitute prior art.

Physical games such as board games and boardless card games remain popular today due to their simplicity and relatively low cost when compared to other forms of entertainment such as electronic games, sporting games/equipment and the cinema. The appeal of these games seem to lie in the fact that they combine one or more different elements such as luck, risk taking, weighing and calculating odds, general knowledge and/or strategy, for example, thereby providing a source of interest and excitement. Physical games also tend to promote social interaction, particularly amongst family members, which is desirable especially given the busy lifestyle that most people lead and the need to find ways to spend quality family time together.

There are a large number of known card games utilizing standard playing cards, as well as board games utilizing a playing board and game pieces wherein players navigate the board based on provided instructions. In each of these games, players interact with each other through either the cards or the board pieces, but do not make physical contact with one another. Additionally, owing to the relatively delicate nature of playing cards and board games, it is not common to utilize these games in outdoor settings at locations such as the pool or beach, for example, where the pieces may be exposed to water and can become ruined. However, it is at these locations that many families congregate together, and therefore would be most likely to utilize such a game.

Accordingly, there remains a need for a liquid splat game and method of play which can provide direct interaction between the players in an outside environment and can be enjoyed by participants of all ages.

SUMMARY OF THE INVENTION

The present invention is directed to a liquid splat game kit. One embodiment of the present invention can include a plurality of squirt bottles for storing water, a plurality of water coloring tablets for transitioning the water into a colored liquid, a plurality of playing cards, and a game-play manual. Each of the tablets and bottles can further include a color indicator, which can also be provided on a plurality of the cards. Each of the bottles can function to discharge the colored liquid when squeezed, and each of the cards can function to instruct a player who to splat with the bottle.

In another embodiment, the kit can also include a waterproof bag for storing and transporting the kit contents.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
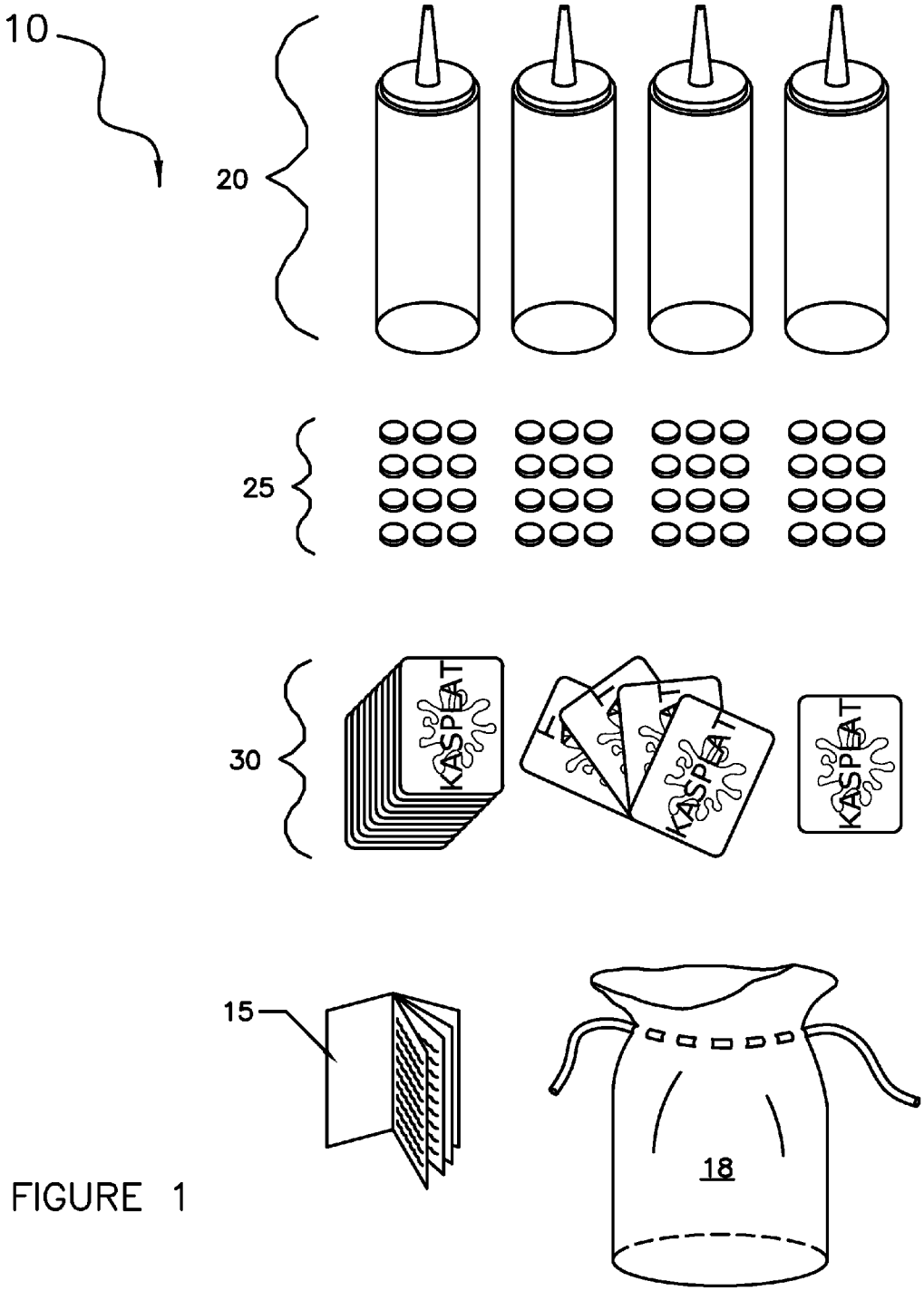
FIG. 1 is a perspective view of a liquid splat game kit that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

The Game Kit

FIG. 1 illustrates one embodiment of a liquid splat game that is useful for understanding the inventive concepts disclosed herein. As shown, the game 10 can include a plurality of squirt bottles 20, a plurality of water coloring tablets 25, a plurality of playing cards 30, and a game-play manual 15. The kit can also include an optional container, such as a waterproof bag 18, for example, which can function to store and transport the other kit contents.

Figure 2:
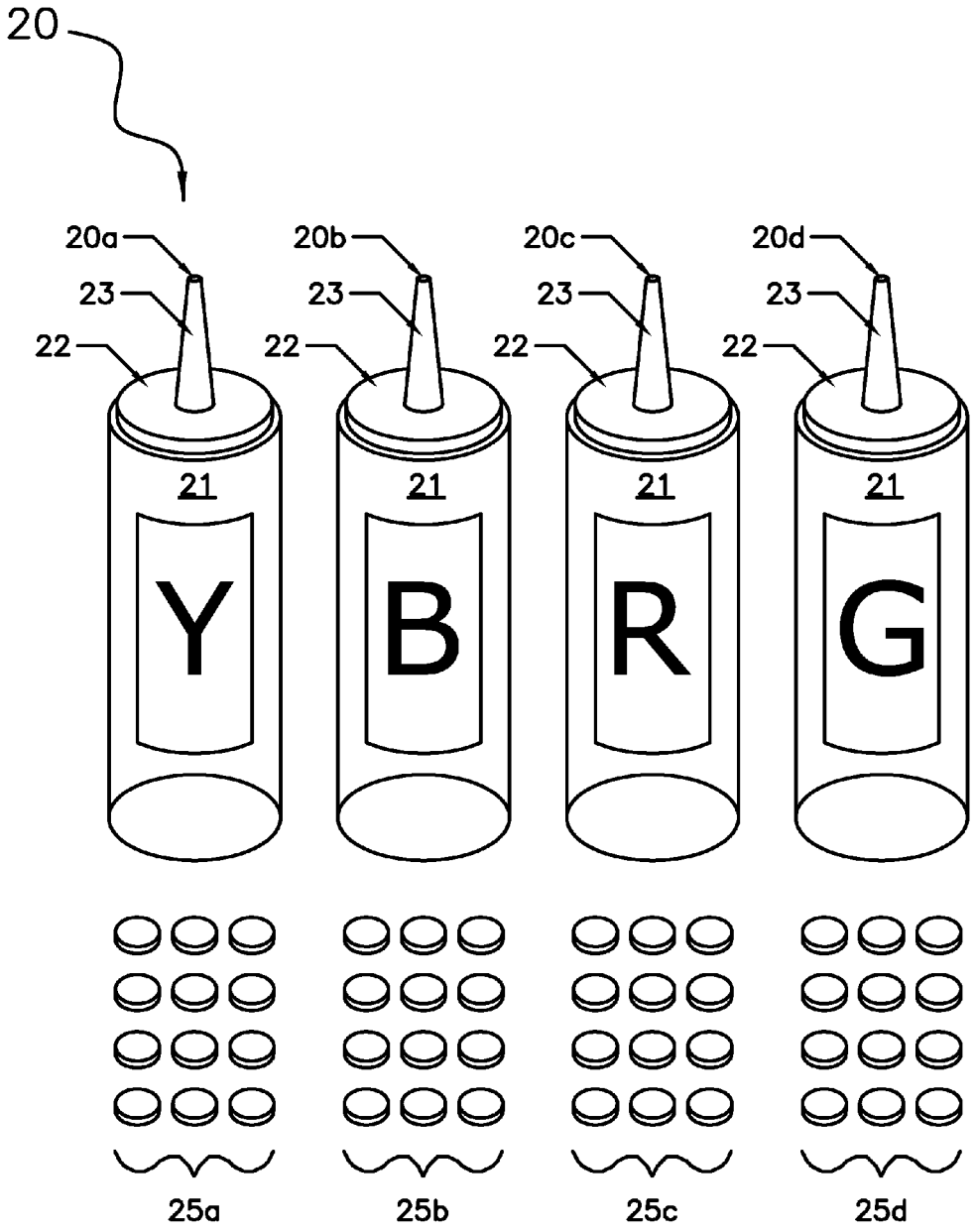
FIG. 2 is a front perspective view of the bottles and water coloring tablets of the liquid splat game kit, in accordance with one embodiment of the invention.

As shown in FIG. 2, each of the bottles 20 can preferably comprise an eight-ounce condiment squeeze bottle having a cavernous waterproof main body 21, a removable twist top 22 and a dispenser 23 that functions to discharge the contents of the main body when a pressure is applied to the outside surface thereof.

In one preferred embodiment, the game can include four bottles 20*a*, 20*b*, 20*c* and 20*d*, each having a color indicator disposed thereon. For example, the bottles 20*a*-20*d* can include color indicators having the letters Y, B, R and G, which represent the colors Yellow, Blue, Red and Green, respectively. Of course, the game is not limited to this number of bottles and these colors, as any number of different bottles, colors and/or color combinations can also be utilized. More-over, the color indicators can include an infinite number of items such as shapes, symbols, numbers, letters, characters and colors, for example.

Although described above as including 8 oz condiment bottles, this is for illustrative purposes only, as any number of known containers of any size that are capable of storing and dispensing liquid contents can also be utilized herein.

The game 10 can also include a plurality of water coloring tablets that correspond to the colors described above. In one preferred embodiment, each of the tablets can include non-staining, non-toxic fizzing color tablets that are commercially available from Spangler science, INC. Of course any number of other non-toxic dyes and other such materials that are capable of interacting with a clear liquid, such as water, and physically transforming the same into a colored liquid having a predetermined pigment can also be utilized herein.

In the preferred embodiment, the game can include a plurality of yellow tablets 25*a*, a plurality of blue tablets 25*b*, a plurality of red tablets 25*c* and a plurality of green tablets 25*d*. Each of these tablets being suitable for insertion into the main body of the bottles 20*a*-20*d*, respectively, and function to create colored liquids when mixed with water.

Figure 2A:
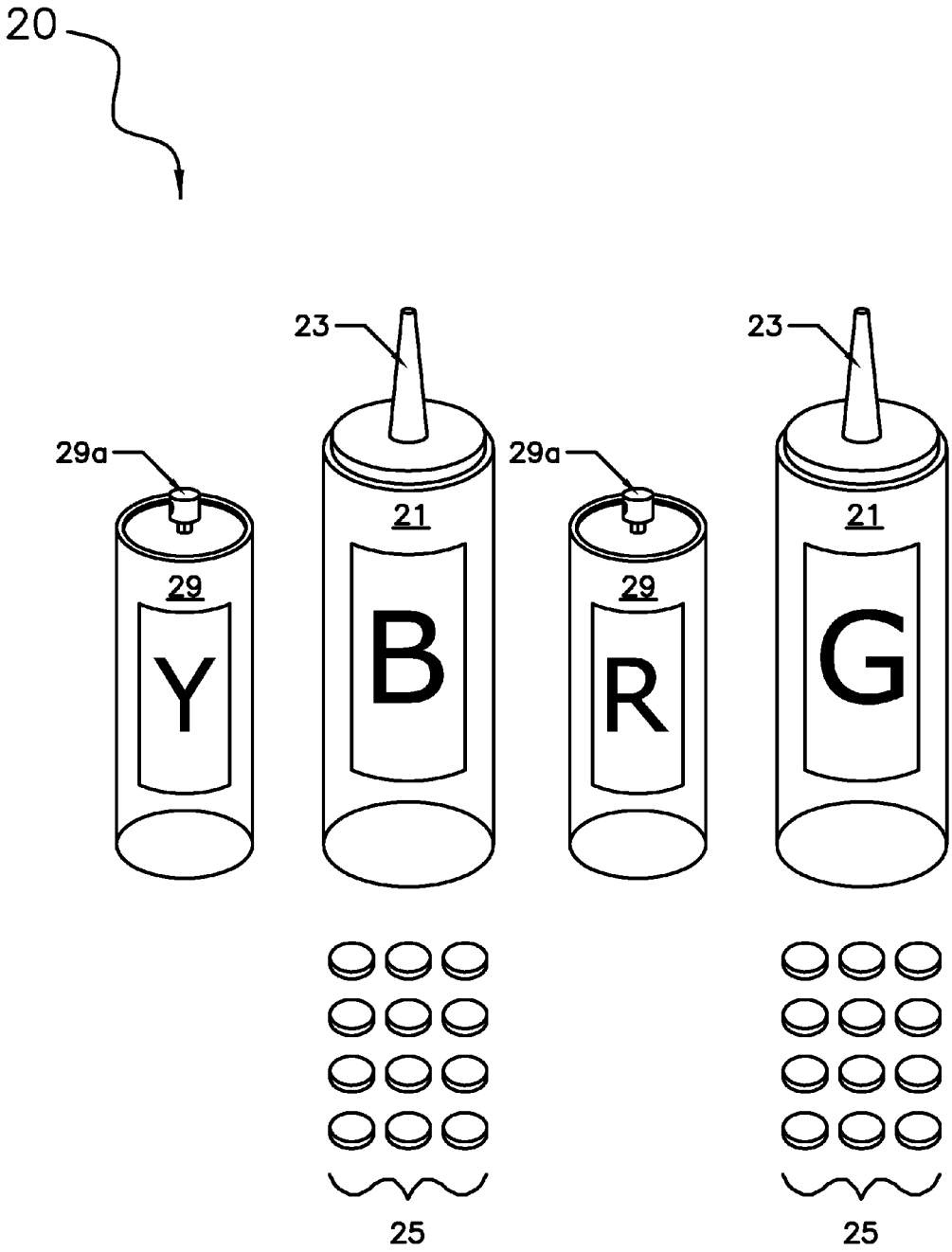
FIG. 2A is a front perspective view of the game bottles, water coloring tablets, and aerosol string containers of the liquid splat game kit, in accordance with another embodiment of the invention.

Although described above as utilizing a plurality of bottles 20 and tablets 25, other embodiments are also contemplated. As shown in FIG. 2A one or more of the bottles and tablets can be replaced with any number of colored aerosol string containers 29 each including the above described color indicators, and a dispenser 29*a* which functions to dispense aerosol string having the indicated color. One suitable example of colored aerosol string container can include the commercially available SILLY STRING®, for example. To this end, although illustrated as used in conjunction with one or more of the bottles and tablets, those of skill in the art will recognize that some versions of the game can be provided wherein each of the bottles and tablets are replaced with aerosol string containers. Such a feature can function to allow the game to be played indoors without risk of damaging furniture, carpets and other such items.

Figure 3:
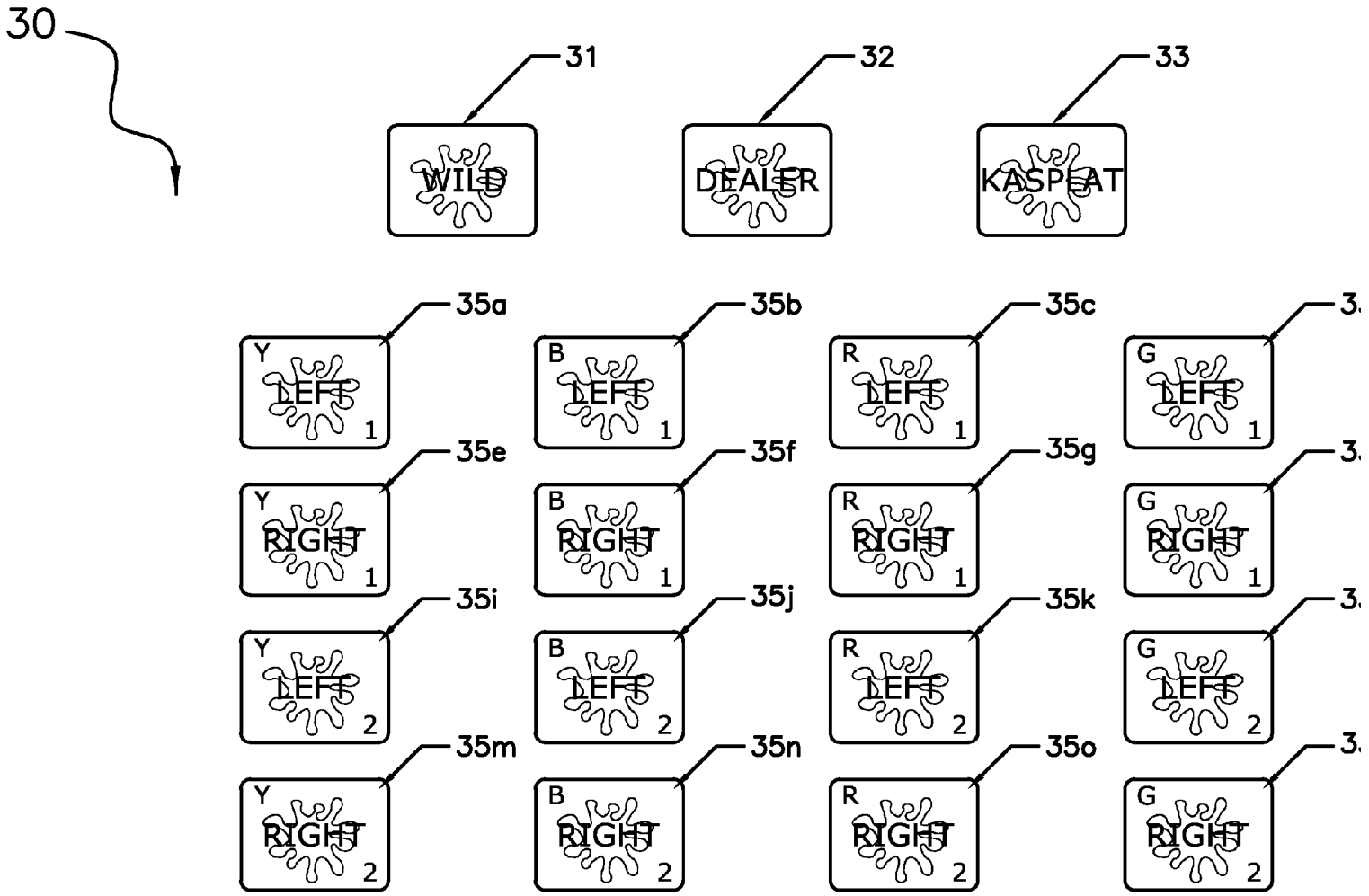
FIG. 3 is top view of the deck of game cards of the liquid splat game kit, in accordance with one embodiment of the invention.

FIG. 3 illustrates one embodiment of the deck of game cards 30 for use with the game 10. As shown, each individual card includes a waterproof main body having a plurality of markings imprinted on at least one side.

In the preferred embodiment, the deck of game cards 30 can include seventy-six individual cards that are separated into special cards and standard cards. The special cards including four WILD cards 31, four DEALER cards 32, and four KASPLAT cards 33. The sixty-four individual game cards can include sixteen groups 35*a*-35*p*, of four individual cards, each having an identical color indicator Y, B, R and G, a direction LEFT or RIGHT, and a number 1 or 2. As will be described below, the sixteen different player cards 35*a*-35*p* function to indicate a particular player who is to be squirted by the colored bottle during game play.

Although described above as including a specific number of cards, each having the number 1 or 2, and the direction LEFT or RIGHT, right, this is for illustrative purposes only, as other embodiments having a different number of cards, different directions, such as forward or backward, and different number markings are also contemplated. Additionally, the color indicators Y, B, R and G are used for consistency with the above color description. As such, the cards can also be imprinted with an infinite number of markings such as shapes, symbols, numbers, letters, characters and colors, for example to provide a correlation with the colored liquid contained within the bottles 20*a*-20*d*.

Game Play

Figure 4:
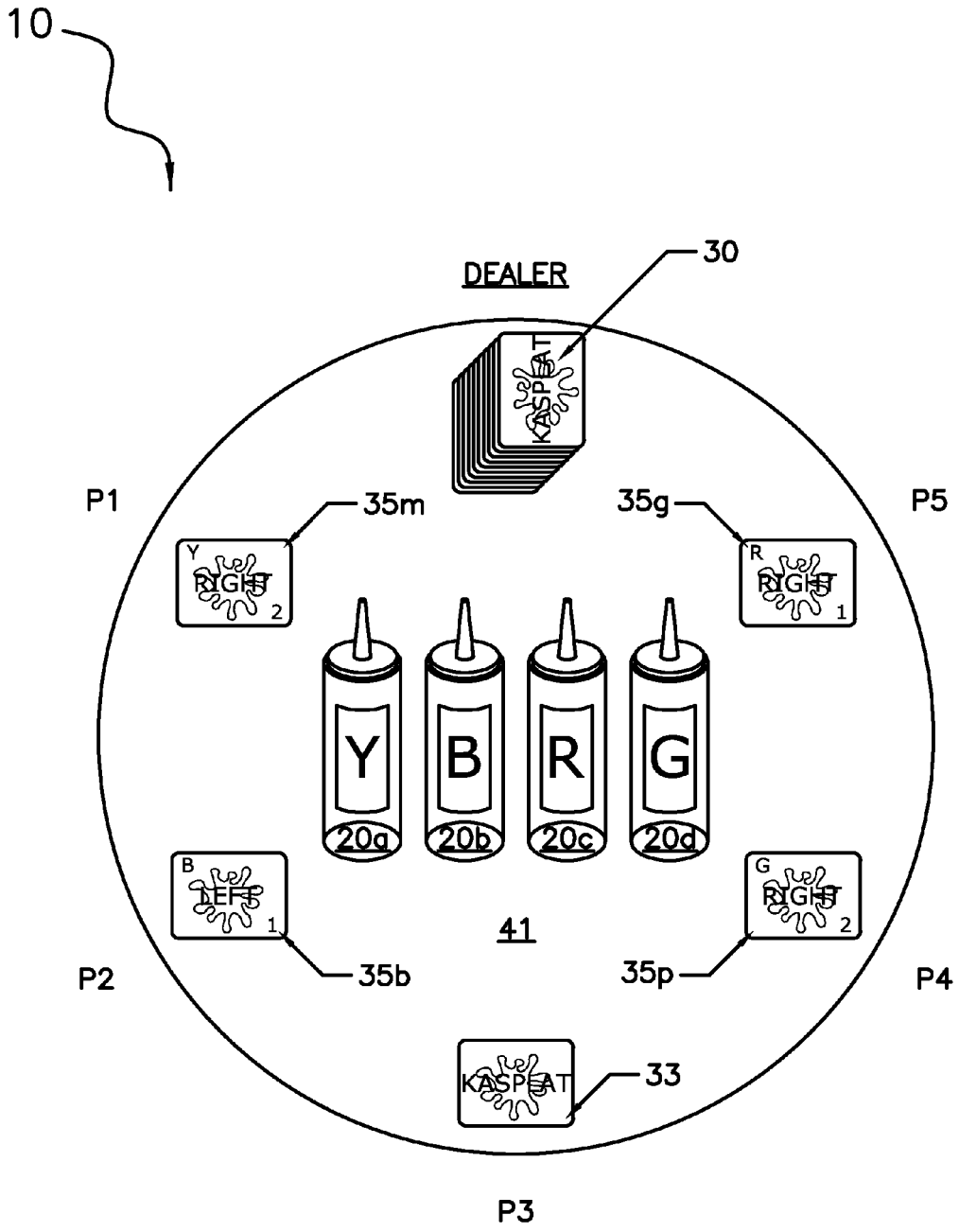
FIG. 4 illustrates the liquid splat game kit in operation, and in accordance with one embodiment of the invention.

FIG. 4 and the description below illustrate one method of playing the game 10 utilizing the game components described above. The below described method, or portions thereof, can also be imprinted onto the game-play manual 15 illustrated in FIG. 1, which is preferably constructed from a waterproof material. As would be known to one of skill in the art, many modifications and alterations to the preceding description can be employed without deviating from the scope and spirit of the inventive concepts disclosed herein.

In order to begin the game, each of the four bottles 20*a*-20*d* can be filled with water and at least one tablet 25*a*-25*d*. The bottles can then be vigorously shaken to transform the separate elements into a cohesive colored liquid. Each of the filled bottles (referred to hereinafter as "colored bottles") can be placed at a central location such as a table 41, for example.

Each of the players P1-Pz can position themselves around the table with their hands on their laps. Alternatively, the game can be played on the ground with each player sitting in a circle.

When all players are ready to begin, the dealer can deal the first hand consisting of a single being dealt to each player facing up (i.e. the writing is visible). The dealer does not deal a card to himself. Once the hand has been dealt, each player will compare their card with the other players' cards. If no two players have matching cards, the dealer will deal another hand.

When a match occurs, both players holding the matching cards will race to grab the bottle 20*a*-20*d* having the color indicated by the matching cards. For example, players P1 and P4 each have card 35 m, (i.e., YELLOW, 2-RIGHT). As such, both players will attempt to grab bottle 20*a* from the center of the table.

The player who grabs the correct bottle first must then splat (i.e., squirt) another player with the colored liquid, as instructed by the number and direction on the matching cards. For example, if P1 grabs the bottle first, he/she must splat P3, whereas if P4 grabs the bottle first, he/she must splat P1 (the dealer does not count as a player). Players are allowed to dodge and/or move to avoid being splatted, but they must remain seated.

After each hand has been dealt, the deal is passed to the dealers left for the next hand. If there are two matches in the same hand, the player who picks up the correct colored bottle (s) first can splat all the remaining players.

Special Cards. If there is a DEALER/DEALER card match during any hand, all players can pick up any colored bottle and splat the dealer. If there is a KASPLAT/KASPLAT card match, all players can pick up any color and splat only one other player. If any player is dealt a WILD card, then that player's card will match the card of the next card dealt.

Responsibilities of the dealer. In addition to dealing the cards, the dealer has additional responsibilities. For example, if a player splats the wrong player, the dealer will point to the player who made the mistake and all players will splat that player with any color. If any player has their hand(s) above the table prior to a match, the dealer will point to that player and all the other players will splat that player with any color. Finally, if any player splats another player in the face, the dealer will point to that player and all the other players will splat that player with any color.

The game is over when all players have dealt a hand, and the winner of the game is the player who is the cleanest at the end of the game. All players except the winner must clean the gaming area and the game bottles at the end of the game.

As described above, the liquid splat game 10 and method of playing the same can provide direct interaction between the players in an outside environment which can be enjoyed by participants of all ages.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A game kit, comprising: a plurality of squirt bottles, each having a dispenser that functions to discharge a liquid stored within the bottle; a plurality of color indicators that are disposed onto each of the plurality of bottles; a plurality of water coloring tablets that are complementary to the color indicators, each of said tablets functioning to transform water into a colored liquid; and a deck of waterproof game cards; and further comprising at least one container of colored aerosol string.

2. The kit of claim 1, wherein the deck of game cards includes seventy-six individual cards that are separated into twelve special cards and sixty-four standard cards.

3. The kit of claim 2, wherein the special cards include four WILD cards, four DEALER cards and four KASPLAT cards.

4. The kit of claim 2, wherein the sixty-four standard cards each includes a direction, a number, and one of the color indicators.

5. The kit of claim 4, wherein the sixty-four standard cards include sixteen groups of four individual cards, each having an identical direction, number, and color indicator to each other.

6. The kit of claim 4, wherein the direction consists of left or right.

7. The kit of claim 4, wherein the number consists of 1 or 2.

8. The kit of claim 1, wherein the plurality of squirt bottles comprises:

four malleable squeeze bottles.

9. The kit of claim 1, wherein the plurality of color indicators represent the colors yellow, blue, red and green.

10. The kit of claim 9, wherein the plurality of color indicators consist of the colors yellow, blue, red and green.

11. The kit of claim 1, wherein the plurality of water coloring tablets are constructed from a non-staining and non-toxic material.

12. The kit of claim 1, further comprising:

a waterproof bag that functions to store and transport the kit components.

13. The kit of claim 1, further comprising:

a game-play manual having instructions for playing the kit imprinted thereon.

14. The kit of claim 13, wherein the game-play manual is waterproof.

15. A game kit, comprising: a plurality of colored aerosol string containers, each having a dispenser that functions to discharge a colored aerosol string that is stored within the container; a plurality of color indicators that are disposed onto each of the plurality of containers; a deck of waterproof game cards; and a plurality of water coloring tablets that are complementary to the color indicators, each of said tablets functioning to transform water into a colored liquid; and further comprising at least one squirt bottles having a dispenser that functions to discharge a liquid stored within the bottle.

16. The kit of claim 15, further comprising:

a game-play manual having instructions for playing the kit imprinted thereon.

17. The kit of claim 1, wherein the deck of game cards includes seventy-six individual cards that are separated into twelve special cards and sixty-four standard cards, and said special cards include four WILD cards, four DEALER cards and four KASPLAT cards.

18. The kit of claim 17, wherein each of the sixty-four standard cards include:

a direction consisting of left or right, a number consisting of 1 or 2, and one of the color indicators.

19. The kit of claim 18, wherein the sixty-four standard cards include sixteen groups of four individual cards, each having an identical direction, number, and color indicator to each other.

* * * * *